US010066494B2

(12) United States Patent
Kim et al.

(10) Patent No.: US 10,066,494 B2
(45) Date of Patent: Sep. 4, 2018

(54) TURBINE WITH BUCKET FIXING MEANS

(71) Applicant: DOOSAN HEAVY INDUSTRIES & CONSTRUCTION CO., LTD., Changwon-si, Gyeongsangnam-do (KR)

(72) Inventors: Jung Chan Kim, Busan (KR); Young Ho Ju, Changwon-si (KR); Jung Ho Lee, Busan (KR); Tae Sub Oh, Gimhae-si (KR); Cheol Hong Kim, Changwon-si (KR)

(73) Assignee: DOOSAN HEAVY INDUSTRIES & CONSTRUCTION CO., LTD., Changwon-Si (KR)

( * ) Notice: Subject to any disclaimer, the term of this patent is extended or adjusted under 35 U.S.C. 154(b) by 753 days.

(21) Appl. No.: 14/515,218

(22) Filed: Oct. 15, 2014

(65) Prior Publication Data

US 2015/0104320 A1 Apr. 16, 2015

(30) Foreign Application Priority Data

Oct. 16, 2013 (KR) ..... 10-2013-0123529

(51) Int. Cl.

| | |
|---|---|
| ***F01D 5/30*** | (2006.01) |
| ***F01D 5/32*** | (2006.01) |
| ***F01D 5/22*** | (2006.01) |

(52) U.S. Cl.

CPC ..... *F01D 5/323* (2013.01); *F01D 5/225* (2013.01); *F01D 5/3007* (2013.01); (Continued)

(58) Field of Classification Search

CPC ..... F01D 5/323; F01D 5/3053; F01D 5/3023; F01D 5/3007; F01D 5/303; F01D 5/3038

See application file for complete search history.

(56) References Cited

U.S. PATENT DOCUMENTS 4,321,012 A * 3/1982 Tan ..... F01D 5/3053 416/217

6,030,178 A 2/2000 Caruso (Continued)

FOREIGN PATENT DOCUMENTS

FR 2344710 A1 10/1977

OTHER PUBLICATIONS

Communication dated Mar. 4, 2015, from European Patent Office in counterpart application No. 14189236.4.

*Primary Examiner* — Justin Seabe

(74) *Attorney, Agent, or Firm* — Sughrue Mion, PLLC

(57) ABSTRACT

There is provided a turbine including a rotor wheel including a plurality of dovetail grooves and at least one insertion groove, the dovetail grooves and the insertion groove arranged in a circumferential direction of the rotor wheel; a plurality of first buckets, each of the first buckets including a vane, a platform provided at a first end portion of the vane, and a dovetail provided at the platform and having a shape corresponding to a corresponding dovetail groove; at least one second bucket including a vane, a platform provided at a first end portion of the vane, and at least one protrusion portion provided at the platform and configured to be inserted into a corresponding insertion groove of the insertion groove; and a fixing member configured to be inserted through the protrusion portion and the rotor wheel and configured to restrict radial movement of the second bucket.

17 Claims, 11 Drawing Sheets

(52) U.S. Cl.
CPC ..... *F01D 5/3023* (2013.01); *F01D 5/3053* (2013.01); *F05D 2220/31* (2013.01); *F05D 2230/60* (2013.01)

(56) References Cited

U.S. PATENT DOCUMENTS

| | | | | |
|---|---|---|---|---|
| 6,364,613 | B1 * | 4/2002 | Deallenbach | F01D 5/3053 415/115 |
| 6,416,286 | B1 * | 7/2002 | Roberts | B23P 15/006 29/889.21 |
| 7,921,556 | B2 * | 4/2011 | Bracken | F01D 5/3046 29/401.1 |
| 8,459,956 | B2 * | 6/2013 | Pandey | F01D 5/143 416/190 |
| 2002/0085917 | A1 | 7/2002 | Roberts et al. | |

* cited by examiner

TURBINE WITH BUCKET FIXING MEANS

CROSS-REFERENCE(S) TO RELATED APPLICATIONS

This application claims priority to Korean Patent Application No. 10-2013-0123529, filed on Oct. 16, 2013 the disclosure of which is incorporated herein by reference in its entirety.

BACKGROUND OF THE INVENTION

1. Field of the Invention

Exemplary embodiments of the present invention relate to a turbine, and more particularly, to a turbine in which rotor blades (buckets) are detachably fixed to a rotor wheel.

2. Description of the Related Art

A steam turbine is an apparatus which converts kinetic energy into rotational force by rotating blades using high-temperature and high-pressure steam generated by a large boiler for a power plant. The steam turbine is classified into a high-pressure turbine, a medium-pressure turbine, and a low-pressure turbine and maximizes efficiency.

FIG. 1 is a perspective view illustrating an internal configuration of the high-pressure turbine. The steam turbine includes an outer casing 1 and an inner casing 2 defining an external appearance and a frame thereof, a rotor 3 which is rotatably installed to the casing 1, a plurality of rotor wheels 4 installed so as to be integrally rotatable with the rotor 3, and rotor blades 5 (hereinafter, referred to as "buckets") mounted at each of the rotor wheels 4 in a circumferential direction thereof.

FIG. 2 is a perspective view illustrating an example of buckets according to the related art. Each bucket 10 includes a vane 11, a shroud 12 formed at a radial outer end portion of the vane 11, and a dovetail 13 formed at a radial inner end portion of the vane 11.

The dovetail 13 is a component for fixing the bucket 10 to a rotor wheel 14. The dovetail 13 may be classified into (1) a tangential entry type, (2) an axial entry type, (3) a pinned finger type, and (4) a keyed axial entry type, according to a manner of coupling the dovetail 13 to the rotor wheel 14. In the types of numbers (1) and (3), the dovetail is tangentially (or circumferentially) inserted and coupled to the rotor wheel. In the types of numbers (2) and (4), the dovetail 13 is axially inserted and coupled to the rotor wheel 14.

The dovetail 13 shown in FIG. 2 is an axial entry type dovetail. Referring to FIG. 2, dovetail grooves 15 are circumferentially formed at intervals on a circumferential portion of the rotor wheel 14. Each of the dovetail grooves 15 has a cross-sectional shape in the form of a corrugation at both axial sides thereof based on a radial cross-section thereof. In this case, the dovetail 13 of the bucket 10 also has a shape corresponding to the dovetail groove 15. That is, the dovetail 13 and the dovetail groove 15 have a male and female coupling relation.

In a method of assembling the bucket 10 in which the axial entry type dovetail 13 is applied, the bucket 10 integrally includes the shroud 12, the vane 11, and the dovetail 13, and the bucket 10 is axially inserted and assembled to the dovetail groove 15 using the dovetail 13 along the circumferential portion of the rotor wheel 14.

In the conventional method of assembling the bucket 10 of the steam turbine in which the axial entry type dovetail 13 is applied, there is however a problem in that it is impossible to assemble a second bucket 20 which is finally assembled since the second bucket 20 interferes with the adjacent bucket 10 (the shroud 12, a platform 11*a*, and the vane 11).

In this regard, U.S. Pat. No. 6,030,178 discloses a method of opening adjacent buckets 10 in opposite directions (a tangential direction; ①) and then inserting a second bucket 20 in a radial direction (①) so that the second bucket 20 is seated and installed to a rotor wheel 14. Finally, a so-called Caruso key 16 is simultaneously inserted and coupled to a dovetail groove 15 of the rotor wheel 14 and a dovetail groove 21 of the second bucket 20 in an axial direction (①).

However, the above related art has the following problems.

First, in order to insert the Caruso key 16, the existing dovetail (a protruding portion) should be cut and the dovetail groove 21 should be separately formed on a platform (a root portion) 11*a* of the second bucket 20, thereby increasing the sizes of the buckets 10 and 20. Thus, there are problems in that centrifugal stress of the buckets 10 and 20 is increased and a consumed bucket material is increased.

Secondly, since the Caruso key 16 is made of an inconel material so as to withstand high centrifugal stress, it has heat transfer properties different from the bucket made of a steel material. Therefore, due to excessive thermal stress caused by a difference in thermal expansion at hot parts of the key, there may be a limit in terms of a design. In addition, since the key itself has a complicated shape, the key may have poor machinability and material costs thereof may be increased.

SUMMARY OF THE INVENTION

Therefore, the present invention has been made in view of the above problems, and it is an object of the present invention to provide a turbine capable of being more easily assembled compared to the related art.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, there is provided a turbine including a rotor wheel including a plurality of dovetail grooves and at least one insertion groove, the plurality of dovetail grooves and the at least one insertion groove arranged in a circumferential direction of the rotor wheel; a plurality of first buckets, each of the plurality of first buckets comprises a first vane, a first platform provided at a first end portion of the first vane, and a dovetail provided at the first platform and having a shape corresponding to a corresponding dovetail groove of the plurality of dovetail grooves; at least one second bucket comprising a second vane, a second platform provided at a first end portion of the second vane, and at least one protrusion portion provided at the second platform and configured to be inserted into a corresponding insertion groove of the at least one insertion groove; and a fixing member configured to be inserted through the at least one protrusion portion and the rotor wheel and configured to restrict radial movement of the at least one second bucket.

The at least one insertion groove may include a plurality of insertion grooves, the rotor wheel further comprising a land portion provided between the plurality of insertion grooves and the land portion and the at least one insertion groove are alternately arranged.

The fixing member may have a circular cross-sectional shape, and each of the rotor wheel and the at least one protrusion portion comprises at least one circular through-hole axially spaced apart from each other.

An axial length of the fixing member is longer than a diameter thereof.

The fixing member may include at least two fixing members radially spaced apart from each other.

A radial length of the insertion groove may be larger than a radial length of each of the dovetail grooves circumferentially spaced on a circumferential portion of the rotor wheel, and a radial length of the at least one protrusion portion may be larger than the radial length of each of the dovetail grooves.

The land portion extending circumferentially may connect axial inner surfaces of the at least one insertion groove and a height of the land portion is lower than a height of a circumferential surface of the rotor wheel adjacent to the axial inner surfaces of the at least one insertion groove, the land portion configured to guide insertion and seating of the second platform.

The first bucket may further include a first shroud which is integrally provided at a second end portion of the first vane; the second bucket may further include a second shroud which is integrally provided at a second end portion of the second vane; and each of the first and second shrouds may include: a planar portion which is tangentially provided at an outer end portion of the first and second vanes; and protrusion hooks radially protruding from opposite end portions of the planar portion, respectively.

Each of the first and second shrouds may include axial decoupling prevention portions circumferentially inclined from an axial end portion of the planar portion and the protrusion hooks may be arranged adjacent to the axial decoupling prevention portions.

Each of the first and second platforms has a flat plate shape, and may include axial decoupling prevention portions circumferentially inclined from opposite sides of an axial end portion of each of the first and second platforms.

Each of opposite end portions of the fixing member may include an axial decoupling prevention hook, the axial decoupling prevention hook configured to protrude circumferentially and radially.

The axial decoupling prevention hook may include a rivet.

The fixing member may include a plurality of fixing members, and the plurality of fixing members may be arranged in an alignment selected from the group consisting of a straight line alignment, a zigzag alignment, a circular alignment, a rectangular alignment, and a two straight line alignment, which are radially spaced apart from each other.

The at least one protrusion portion may include a plurality of protrusion portions, the plurality of protrusion portions axially spaced apart from one another.

In accordance with another aspect of the present invention, there is provided a turbine including a rotor wheel including: a plurality of dovetail grooves extending axially; and at least one insertion groove provided between the plurality of dovetail grooves; a plurality of first buckets, each of the plurality of first buckets comprising a dovetail configured to engage with a corresponding dovetail groove of plurality of dovetail grooves; at least one second bucket comprising a protrusion portion inserted into the at least one insertion groove; and a fixing member inserted through the at least one insertion groove and the protrusion portion and configured to restrict radial movement of the at least one second bucket.

The protrusion portion may include a plurality of protrusion portions provided at a platform of the second bucket, and each of the plurality of protrusion portions are axially spaced apart from one another.

Each of opposite end portions of the fixing member may include a deformation portion, and the deformation portion may protrude from a side of the rotor wheel and configured to be mechanically deformed.

The deformation portion may include a radially expanded portion.

In accordance with a further aspect of the present invention, there is provided a turbine including: a rotor wheel; a plurality of first buckets inserted into the rotor wheel in a first direction; at least one second bucket inserted into the rotor wheel in a second direction; and at least one fixing member configured to be inserted in the first direction and to pass through a portion of the second bucket and the rotor wheel, opposite end portions of the fixing member protruding from a surface of the rotor wheel.

The first direction may be parallel with an axial direction of the rotor wheel and the second direction may be parallel with a radial direction of the rotor wheel.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Exemplary embodiments of the present invention will be described below in more detail with reference to the accompanying drawings so as to be realized by a person of ordinary skill in the art.

Although the present invention is described below as to be applied to a steam turbine in which a second bucket 240 may be assembled during assembly of buckets (rotor blades) axially inserted into a rotor wheel, the present invention is not limited thereto. For example, the present invention may also be applied to any turbine, such as a gas turbine, having a structure for inserting a plurality of buckets or vanes into the rotor wheel.

Figure 1:
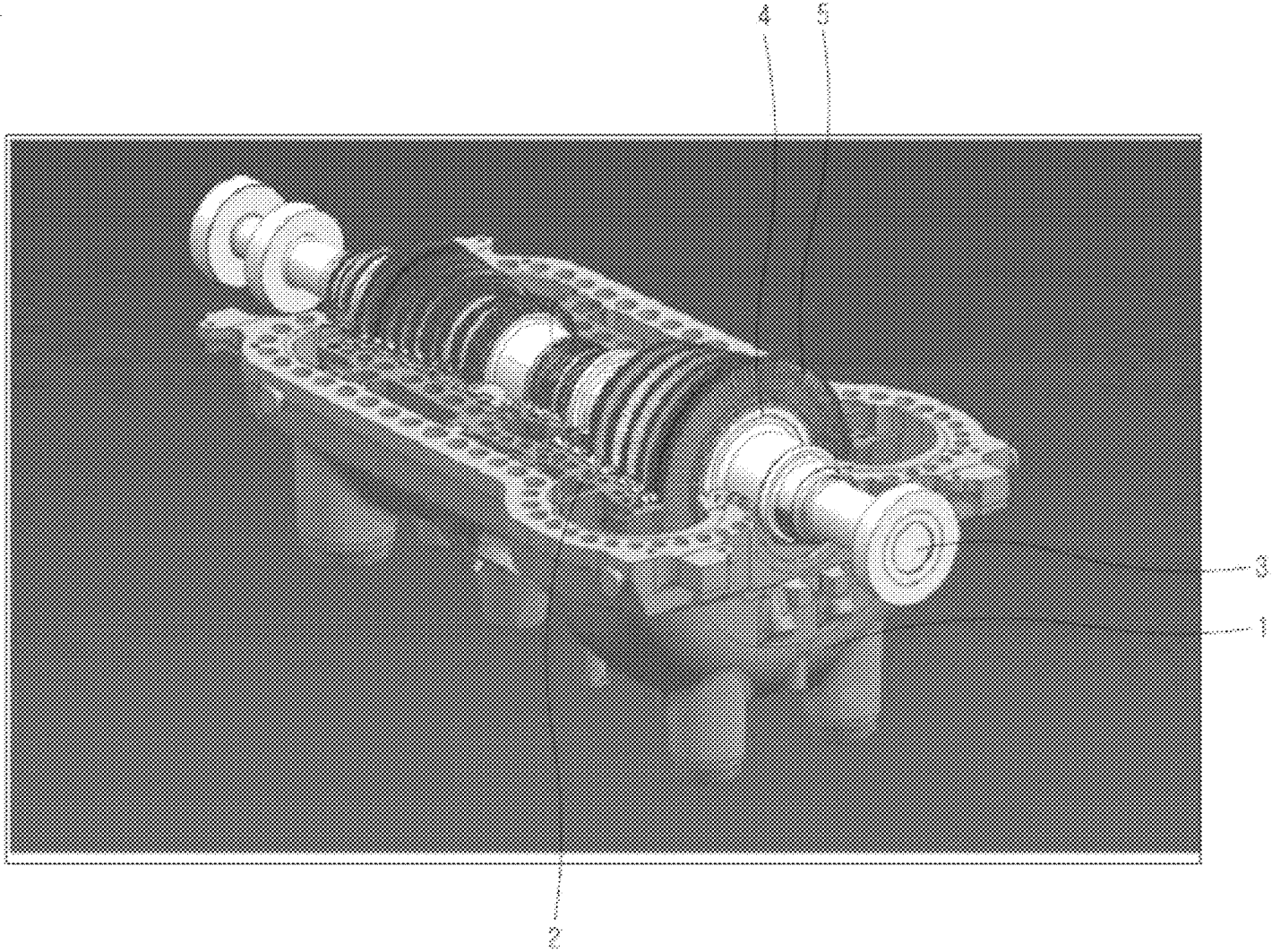
FIG. 1 is a perspective view illustrating an internal configuration of a conventional high-pressure turbine.
Figure 2:
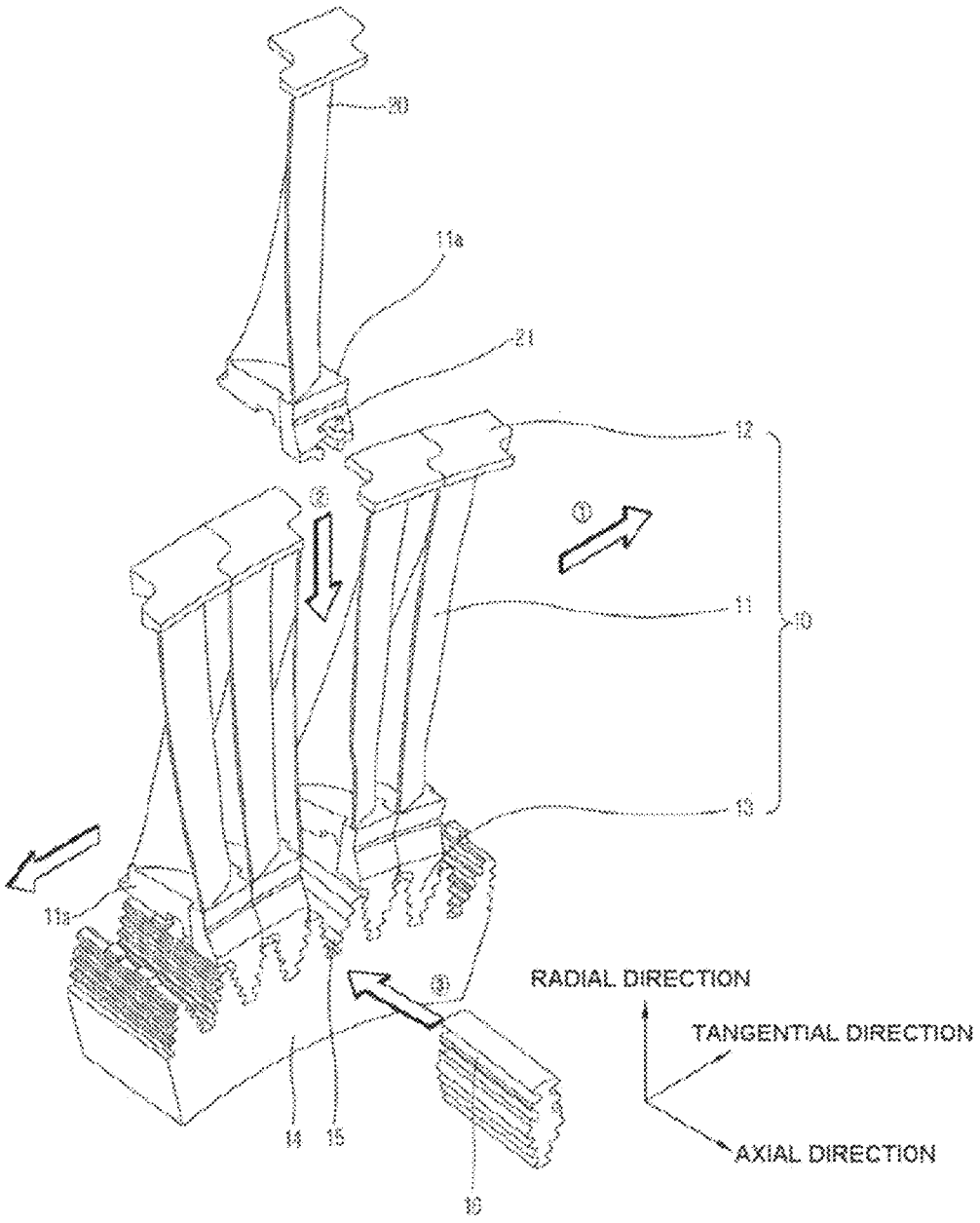
FIG. 2 is a perspective view illustrating an example of buckets according to the related art.
Figure 3:
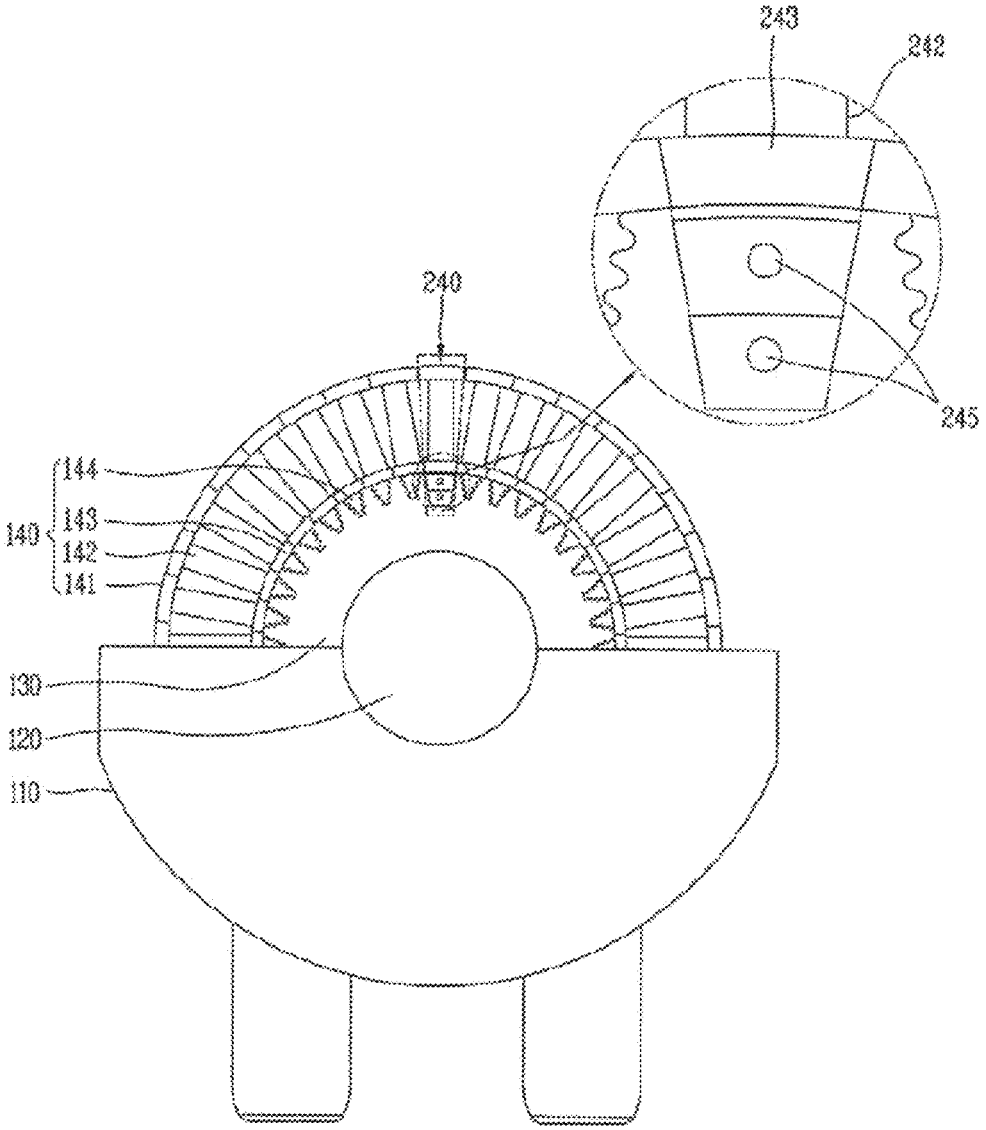
FIG. 3 is an axial front view schematically illustrating an internal configuration of a steam turbine according to an embodiment of the present invention.

FIG. 3 is an axial front view schematically illustrating an internal configuration of a steam turbine according to an embodiment of the present invention.

Referring to FIG. 3, the steam turbine according to the present invention includes a casing 110, a rotor 12, a rotor wheel 130, and buckets 140.

The casing 110 is configured of an upper casing (not shown) and a lower casing 110 which may be coupled to and decoupled from each other, and receives the rotor wheel 130 and the buckets 140 therein, thereby enabling internal components to be blocked or protected from external impacts or foreign matters. The drawing shows only the lower casing 110 to illustrate the internal components.

The rotor 120 may serve as a rotary shaft and both end portions of the rotor 120 may be rotatably supported by bearings.

The rotor wheel 130 may have a circular or disc shape. The rotor wheel 130 has a hollow hole provided at a central portion thereof, and the rotor 120 is coupled to the rotor wheel 130 through the hollow hole so that the rotor 120 and the rotor wheel 130 may integrally rotate. In this case, a key or a serration may be coupled between the rotor 120 and the rotor wheel 130 so as to simultaneously operate the rotor 120 and the rotor wheel 130.

In addition, the rotor wheel 130 has a plurality of dovetail grooves 131 which are circumferentially formed at intervals on a circumferential portion thereof. Each of the dovetail grooves 131 has a certain depth which is axially formed from the outermost edge of the rotor wheel 130. Engagement portions 131*a* having a corrugated curved surface are symmetrically formed on inner surfaces of the dovetail groove 131 on the basis of an imaginary radial center line, so as to engage with a corresponding dovetail 144.

The dovetail groove 131 is radially outwardly opened, and has a circumferential width which becomes smaller as the depth of the groove becomes deeper. The dovetail groove 131 is also axially opened such that the dovetail 144 of the associated bucket 140 to be described later may be inserted and coupled to the dovetail groove 131. In this case, the circumferential width of the dovetail groove 131 is maintained at a certain distance in an axial direction thereof for smooth insertion of the dovetail 144.

The buckets 140 each integrally include a shroud 141, a vane 142, and a dovetail 144, and are axially inserted and mounted along a circumferential surface of the rotor wheel 130 using the dovetails 144. Here, each of the buckets 140 may have any shape including the associated dovetail, and will be referred below to as "a first bucket" for distinguishing with a second bucket to be described later.

The shroud 141 is called as a cover and is installed to a radial outer end portion of the vane 142 so as to serve to prevent a leakage of steam and attenuate vibration. The shroud 141 may have any shape such as a Z-shape, a V-shape, or a linear shape when viewed from the outward and radial direction thereof.

The vane 142 may have various cross-sectional shapes such as a crescent shape and an airfoil shape, and may increase rotational force by generating lift force when a fluid passes through the vane 142 and by doubling velocity energy of the fluid. The vane 142 having such a shape may have a cross-sectional area which increases or decreases as advancing in a longitudinal direction thereof.

The dovetail 144 is an axial entry type dovetail which is axially inserted and coupled to the dovetail groove 131.

A plate-shaped platform 143 is formed at a radial inner end portion of the vane 142. The dovetail 144 is integrally formed at the platform 143 of the vane 142 so as to radially inwardly protrude.

The dovetail 144 is preferably designed to properly withstand centrifugal stress of the first bucket 140 during rotation thereof, and may have, for example, a corrugated shape.

In more detail, the dovetail 144 has a circumferential width, which becomes smaller as advancing in a depth direction of the dovetail groove 131 but is uniformly maintained as advancing in an axial direction of the dovetail groove 131.

In addition, both circumferential sides of the dovetail 144 are configured of a planar surface, and engagement portions 131*a* having a curved surface are symmetrically formed on both axial sides of the dovetail 144 on the basis of a radial center line of the dovetail 144. The curved surface may have a corrugated shape in the depth direction of the groove.

The dovetail 144 having the above structure is axially inserted into the dovetail groove 131, and the dovetail 144 and the dovetail groove 131 engage with each other in a male and female form by the engagement portions 131*a*. Consequent, the dovetail 144 may withstand centrifugal stress of the first bucket 140 during rotation thereof.

Figure 4:
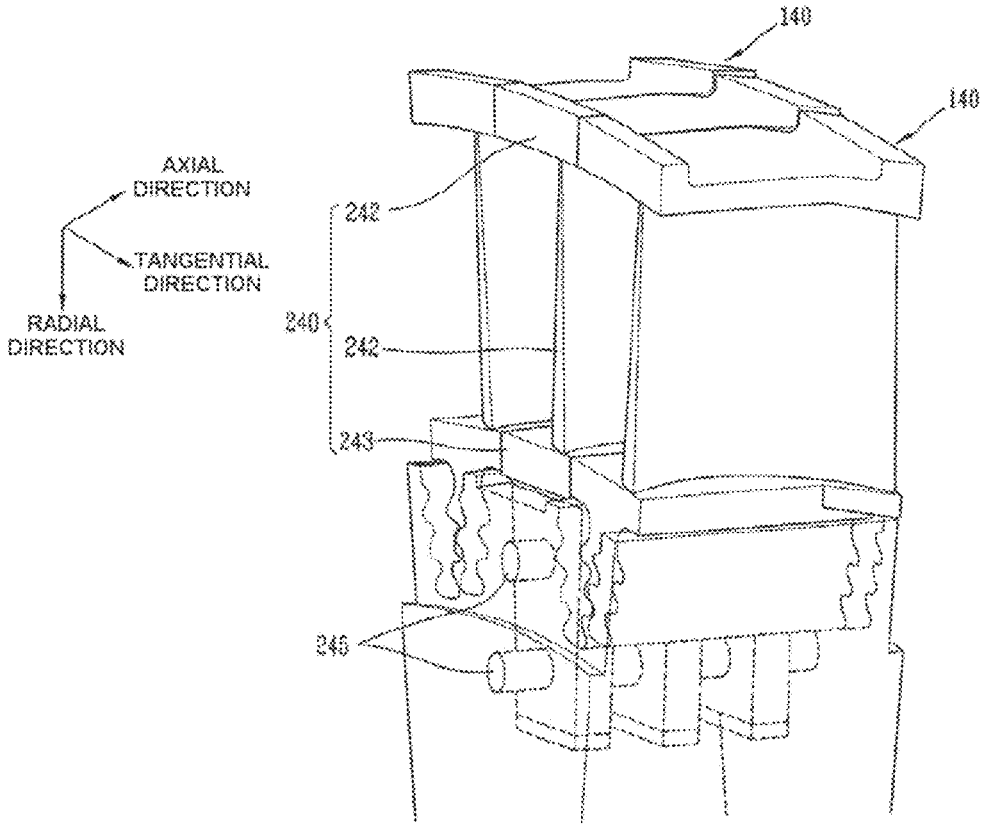
FIG. 4 is a perspective view illustrating a coupling structure between buckets and a rotor wheel according to the embodiment of the present invention.
Figure 5:
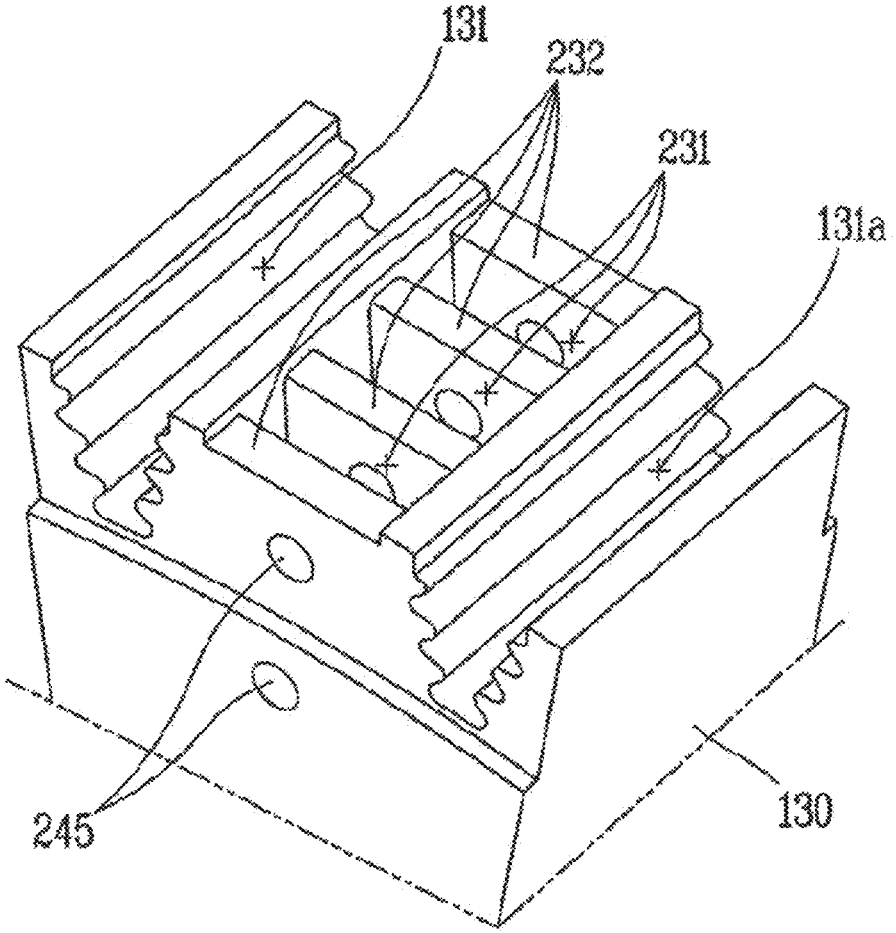
FIG. 5 is a perspective view illustrating a state of insertion grooves and a dovetail groove formed on the rotor wheel.
Figure 6:
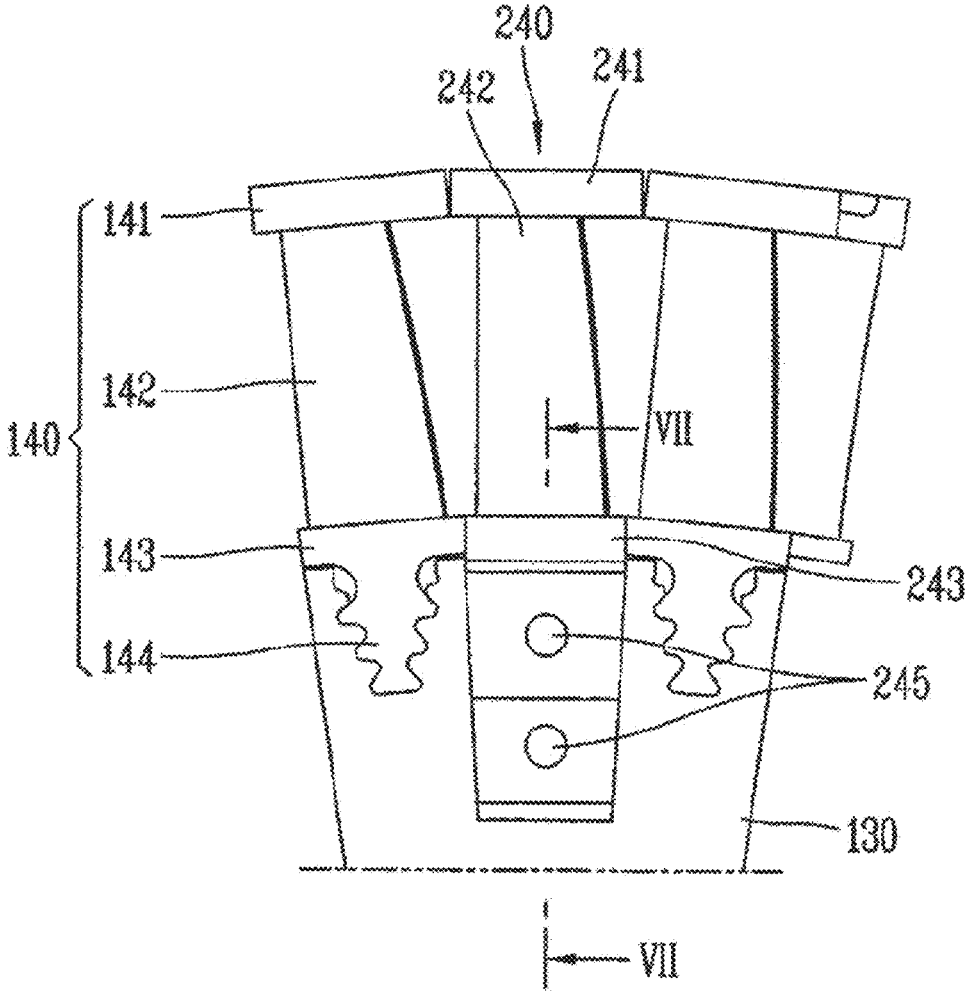
FIG. 6 is an axial front view illustrating a coupling structure between a second bucket and the rotor wheel in FIG. 4.
Figure 7:
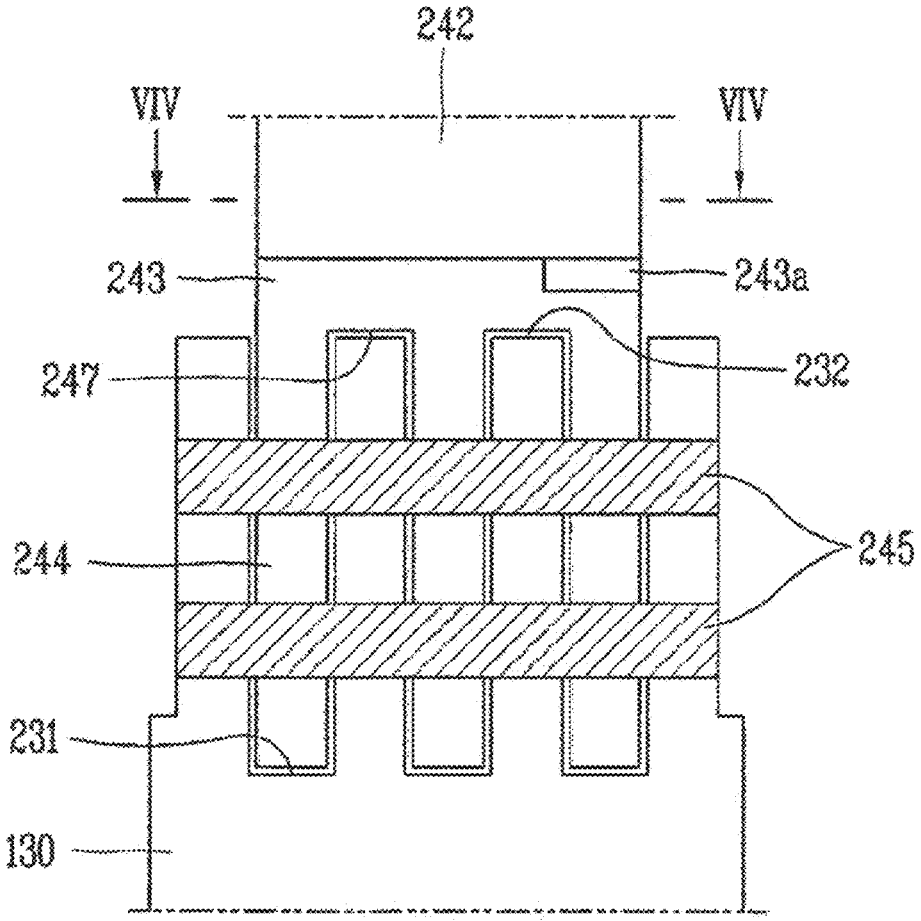
FIG. 7 is a circumferential side view taken along line VII-VII of FIG. 6.

FIG. 4 is a perspective view illustrating a coupling structure between the buckets and the rotor wheel according to the embodiment of the present invention. FIG. 5 is a perspective view illustrating a state of insertion grooves and the dovetail groove formed on the rotor wheel. FIG. 6 is an axial front view illustrating a coupling structure between a second bucket and the rotor wheel in FIG. 4. FIG. 7 is a circumferential side view taken along line VII-VII of FIG. 6.

Here, the first buckets 141 are inserted and coupled to the rotor wheel 130 using the dovetails. However, a second bucket 240, which is finally assembled to the rotor wheel 130 among the first buckets 140, differs from the other first buckets 140 in that the second bucket 240 has a different shape and structure from the first buckets 140. Here, the second bucket may also be provided in plural numbers.

That is, in the embodiment, a dovetail coupling structure for coupling of the second bucket 240 and the rotor wheel 130 includes protrusion portions 244 provided on the second bucket 240 and insertion grooves 231 provided on the rotor wheel 130.

The protrusion portions 244 protrude radially from a platform 243 of the second bucket 240. The number of the protrusion portions 244 may be at least two or three. In this case, the protrusion portions 244 are arranged to be axially spaced at intervals. A protrusion portion 244, which is axially outwardly positioned among the protrusion portions 244, may be arranged to be axially inwardly spaced from a tangential side end portion of the platform 243 spaced in an axial direction thereof.

In addition, each of the protrusion portions 244 has a rectangular plate structure configured of a planar shape as a whole, and thus may be easily inserted without friction or interference. The protrusion portion 244 may have a circumferential side width which becomes smaller as advancing in a radial direction thereof.

The insertion grooves 231 are provided instead of the above dovetail groove, for inserting and mounting the second bucket 240. The insertion grooves 231 are radially deeply formed to be axially arranged at intervals on the circumferential portion of the rotor wheel 130 so as to allow the protrusion portions 244 to be inserted thereinto. Also, the insertion grooves 231 are concavely formed in the same shape as and at positions corresponding to the protrusion portions 244.

Land portions 232 are formed between the insertion grooves 231 and are portions to which the platform 243 of the second bucket 240 is seated. For example, when the protrusion portions 244 of the second bucket 240 are deeply inserted into the insertion grooves 231, channel portions 247 (each of which is a portion of the platform 243 and has a groove shape) formed between the protrusion portions 244 may be seated and coupled to the land portions 232 between the insertion grooves 231.

In this case, radial outer end portions of the land portions 232 circumferentially connect between axial inner surfaces of the insertion grooves 231 and are formed lower than the adjacent circumferential surface of the rotor wheel 130. Therefore, the protrusion portions 244 of the platform 243 may be easily inserted into the insertion grooves 231 and the channel portions 247 of the platform 243 may be easily seated to the land portions 232.

Since the second bucket 240 is impossible to be axially moved and decoupled from the insertion grooves 231 of the rotor wheel 130 but is possible to be radially inserted into and decoupled from the insertion grooves 231, fixing members 245 are provided to prevent decoupling of the second bucket 240.

The protrusion portions 244 and the land portions 232 include a plurality of coupling holes 246 so that the fixing members 245 may be inserted through the coupling holes 246.

Here, the fixing members 245 each have a circular bar shape having a relatively small diameter and a long length and fix the protrusion portions 244 to the land portions 232 through the coupling holes 246.

Figure 8:
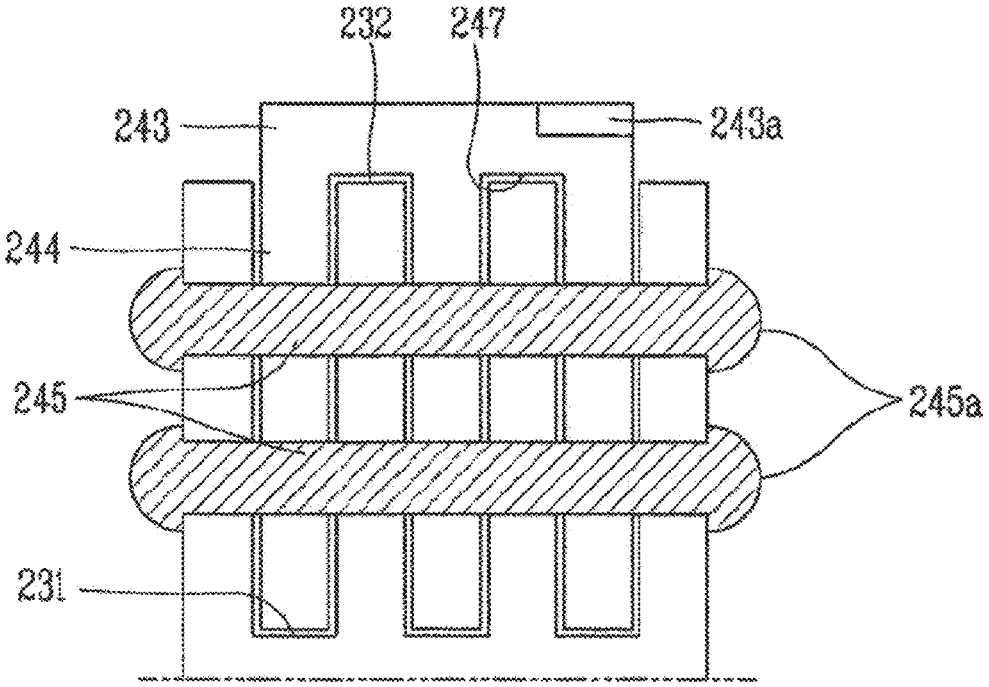
FIG. 8 is a cross-sectional view illustrating a state in which axial decoupling prevention hooks are formed in fixing members in FIG. 7.
Figure 9A:
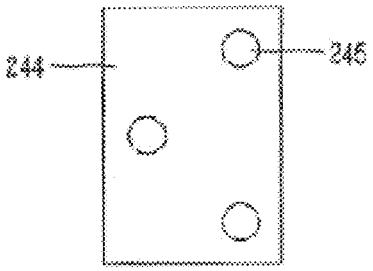
FIGS. 9A-9E are views illustrating various arrangements of the fixing members according to the embodiments of the present invention.
Figure 9B:
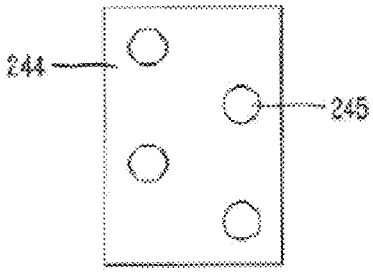
Figure 9C:
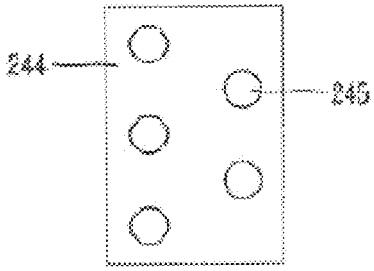
Figure 9D:
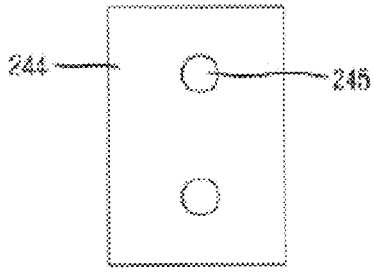
Figure 9E:
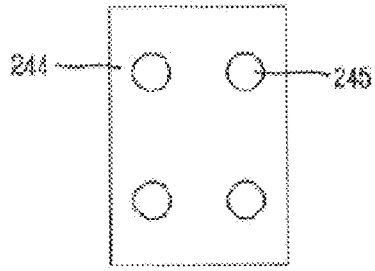

FIG. 8 is a cross-sectional view illustrating a state in which axial decoupling prevention hooks are formed in the fixing members in FIG. 7.

Both end portions of each of the fixing members 245 are provided with axial decoupling prevention hooks 245*a* each of which has a diameter formed to radially outwardly protrude, so that the fixing member 245 may be prevented from being axially decoupled from the protrusion portions 244 and the land portions 232. In this case, the axial decoupling prevention hook 245*a* may be processed by riveting. For example, the axial decoupling prevention hook 245*a* may be processed by inserting a round headed rivet into the coupling holes 246 and then striking an opposite side of the round head with a riveting tool such as a chisel.

Hereinafter, a method of assembling the first buckets 140 according to the present invention will be described.

The plural first buckets 140 are axially inserted and assembled to the respective dovetail grooves 131 which are circumferentially spaced along the circumferential portion of the rotor wheel 130. In this case, it is preferable that the first buckets 140 are sequentially assembled from any one of the dovetail grooves 131 in a clockwise or counterclockwise direction.

Next, the second bucket 240, which is finally assembled among the plural first buckets 140, is radially inserted and assembled.

In this case, the protrusion portions 244 of the second bucket 240 are radially inserted into the insertion grooves 231 so that the channel portions 247 of the platform 243 are seated to the land portions 232 of the rotor wheel 130.

Next, when the insertion of the second bucket 240 is completed, the circular bar-shaped fixing members 245 are inserted into the coupling holes to fix the second bucket 240 and the rotor wheel 130, and thus the assembly of the buckets 140 and 240 is completed.

Particularly, the fixing members 245 are inserted into the coupling holes 246 and fix the protrusion portions 244 and the land portions 232 such that the protrusion portions 244 and the land portions 232 engage with each other and are securely restricted without circumferentially deviating from each other. Thus, the fixing members 245 may securely fix the second bucket 240 to the rotor wheel 130. In addition, since each of the fixing members 245 has a circular cross-sectional shape, it may properly withstand centrifugal force of the buckets 140 and 240 during rotation thereof.

FIGS. 9A-9E are views illustrating various arrangements of the fixing members according to the embodiments of the present invention. Referring to FIG. 9, at least two fixing members 245 may be arranged to be inserted into the protrusion portions 244 and the land portions 232. The fixing members 245 may be arranged in the form of a straight line (FIG. 9D) or in the form of two straight lines (FIG. 9E) so as to be radially spaced apart from each other, or may be arranged in a zigzag form (FIGS. 9A-9C) so as to radially alternate with each other.

Figure 10:
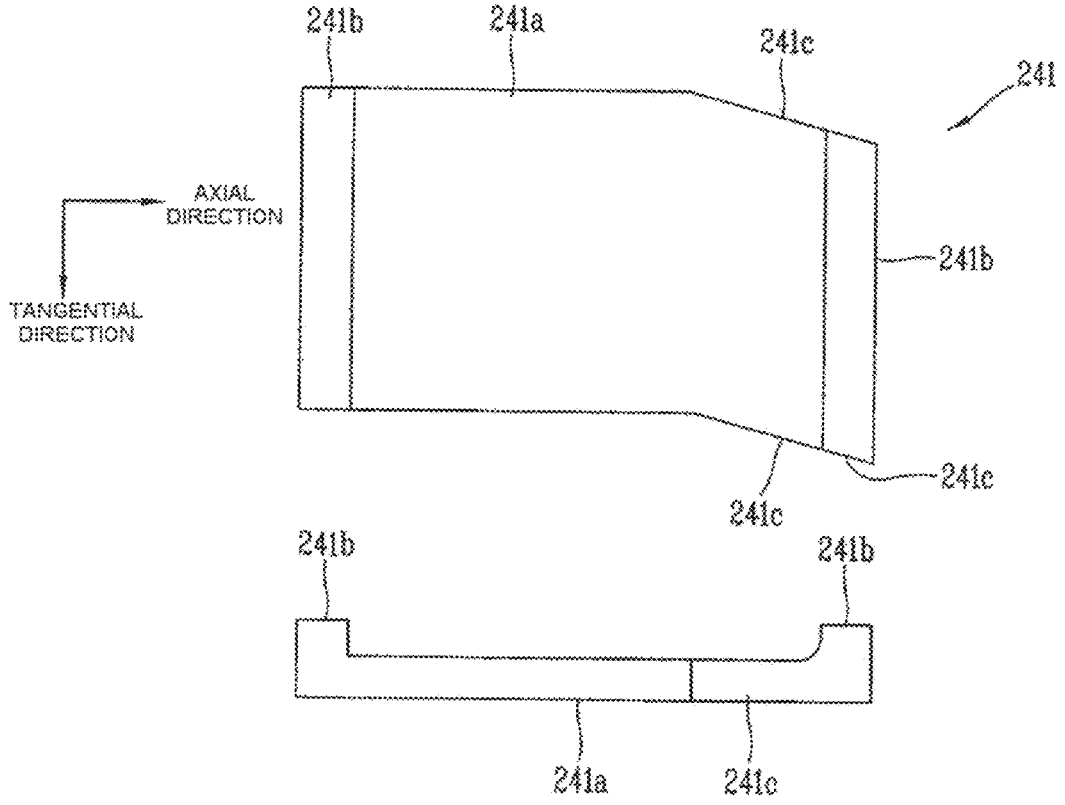
FIG. 10 is top and side views illustrating a shroud in FIG. 6.
Figure 11:
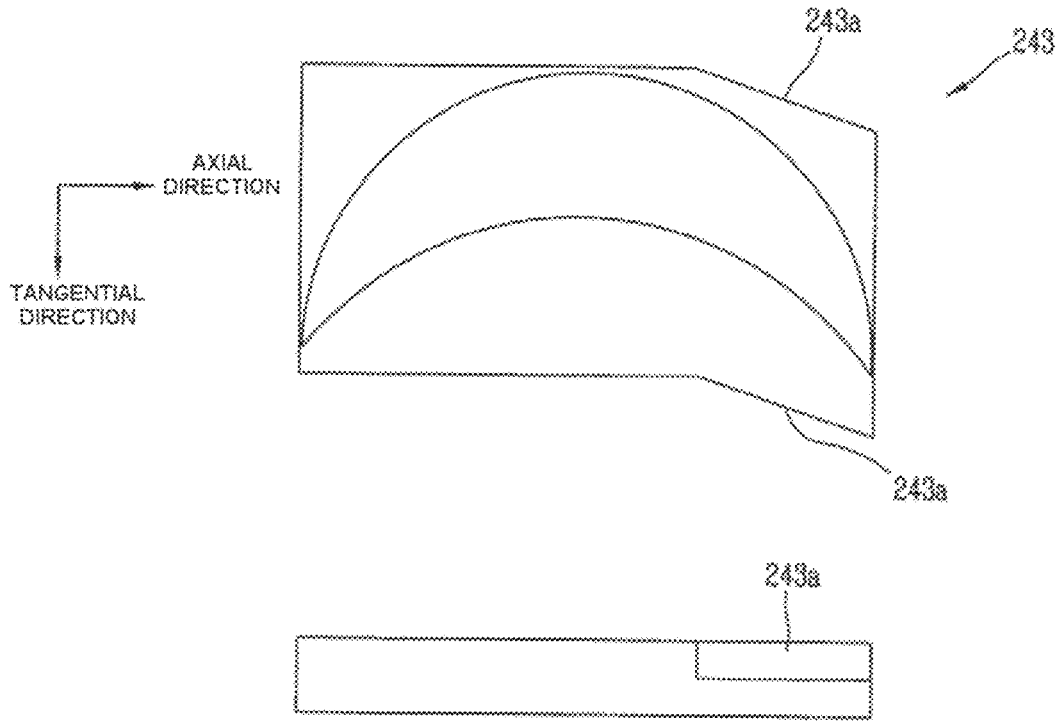
FIG. 11 is a cross-sectional view taken along line VIV-VIV of FIG. 7.

FIG. 10 is top and side views illustrating the shroud in FIG. 6. FIG. 11 is a cross-sectional view taken along line VIV-VIV of FIG. 7.

In the buckets 140 and 240 according to the present invention, the shrouds 141 and 241 may be axially configured in a linear form.

Hereinafter, structures of the shrouds 141 and 241 will be described in more detail. Each of the shrouds 141 and 241 includes a planar portion 241*a* which is tangentially arranged at a radial outer end portion of each of the vanes 142 and 242, protrusion hooks 241*b* which are axially spaced from both end portions of the planar portion 241*a* and radially outwardly protrude, and an axial decoupling prevention portion 241*c* which is tangentially inclined from an axial one end portion of the planar portion 241*a* and the protrusion hooks 241*b*.

The planar portion 241*a* may have a rectangular plate structure configured of a linear planar shape on at least both axial sides thereof.

For example, the axial decoupling prevention portion 241*c* of the shroud 241 engages and is coupled with the axial decoupling prevention portion of the adjacent shroud 141, thereby enabling the shrouds 141 and 241 to be prevented from being decoupled from the dovetail grooves 131 and 231 within an axial length range thereof.

In addition, in the buckets 140 and 240 according to the present invention, since each of the platforms 143 and 243 is tangentially formed on the radial inner side of each of the vanes 142 and 242 and thus a separate space for insertion of the conventional Caruso key is not required, the platform 143 or 243 may have a plate structure having a relatively thin thickness.

In this case, the axial decoupling prevention portion 243*c* may also be applied to the platform 143 or 243 as an inclined structure, as shown in FIG. 11, such that the platform does not depart from the circumferential surface of the rotor wheel 130 within an axial length range thereof. Such a structure may be applied to the platforms 143 of the other first buckets 140.

Accordingly, according to the present invention, there is no need to cut the dovetail formed integrally with the vane or form an insertion space for receiving a separate Caruso key in the platform of the vane as in a case of the conventional patent, by applying together the finger type dovetails 244 and the fixing members 245 to the second bucket 240. Therefore, the turbine may be easily assembled.

Besides, since the heights of the platforms 143 and 243 of the buckets 140 and 240 are lowered, it may be possible to decrease centrifugal force of the buckets 140 and 240 and reduce material costs. In addition, the rotor 120 may be simply machined and easily perform maintenance.

As is apparent from the above description, a turbine according to the embodiments of the present invention has the following advantages.

First, the turbine may be assembled by applying a finger type dovetail to a second bucket without cutting of assembly interference portions such as vanes.

Secondly, the turbine may be easily assembled and facilitate maintenance thereof by applying the finger type dovetail for assembly of the second bucket which is finally assembled.

Thirdly, it may be possible to decrease centrifugal stress of each bucket and reduce material costs thereof by reducing a platform thickness of the bucket.

While the present invention has been described with respect to the specific embodiments, it will be apparent to those skilled in the art that various changes and modifications may be made without departing from the spirit and scope of the invention as defined in the following claims.

What is claimed is:

1. A turbine comprising:

a rotor wheel comprising a plurality of dovetail grooves and a plurality of insertion grooves arranged along an axial direction of the turbine, the plurality of dovetail grooves and the plurality of insertion grooves arranged in a circumferential direction of the rotor wheel;

a plurality of first buckets configured to be inserted into the rotor wheel in the axial direction, each of the plurality of first buckets comprising a first vane, a first platform provided at a first end portion of the first vane, and a dovetail provided at the first platform and having a shape corresponding to a corresponding dovetail groove of the plurality of dovetail grooves;

at least one second bucket comprising a second vane, a second platform provided at a first end portion of the second vane, and a plurality of protrusions provided at the second platform and configured to be inserted into the plurality of insertion grooves, the at least one second bucket configured to be inserted into the rotor wheel in a radial direction; and a fixing member configured to be inserted through the plurality of protrusions and the rotor wheel and configured to restrict radial movement of the at least one second bucket, wherein the rotor wheel further comprising a land portion provided between the plurality of insertion grooves and the land portion and the plurality of insertion grooves are alternately arranged along the axial direction, and wherein each of the plurality of insertion grooves have a different shape from each of the plurality of dovetail grooves.

2. The turbine according to claim 1, wherein the fixing member has a circular cross-sectional shape, and each of the rotor wheel and the plurality of protrusions comprises at least one circular through-hole axially spaced apart from each other.

3. The turbine according to claim 2, wherein an axial length of the fixing member is longer than a diameter thereof.

4. The turbine according to claim 2, wherein the fixing member comprises at least two fixing members radially spaced apart from each other.

5. The turbine according to claim 1, wherein a radial length of the insertion groove is larger than a radial length of each of the dovetail grooves circumferentially spaced on a circumferential portion of the rotor wheel, and a radial length of each of the plurality of protrusions is larger than the radial length of each of the dovetail grooves.

6. The turbine according to claim 1, wherein:

the first bucket further comprises a first shroud which is integrally provided at a second end portion of the first vane;

the second bucket further comprises a second shroud which is integrally provided at a second end portion of the second vane; and each of the first and second shrouds comprises:

a planar portion which is tangentially provided at an outer end portion of the first and second vanes; and protrusion hooks radially protruding from opposite end portions of the planar portion, respectively.

7. The turbine according to claim 6, wherein each of the first and second shrouds comprises axial decoupling prevention portions circumferentially inclined from an axial end portion of the planar portion and wherein the protrusion hooks are arranged adjacent to the axial decoupling prevention portions.

8. The turbine according to claim 1, wherein each of the first and second platforms has a flat plate shape, and comprises axial decoupling prevention portions circumferentially inclined from opposite sides of an axial end portion of each of the first and second platforms.

9. The turbine according to claim 1, wherein each of opposite end portions of the fixing member comprises an axial decoupling prevention hook, the axial decoupling prevention hook configured to protrude circumferentially and radially.

10. The turbine according to claim 9, wherein the axial decoupling prevention hook comprises a rivet.

11. The turbine according to claim 1, wherein the fixing member comprises a plurality of fixing members, and the plurality of fixing members are arranged in an alignment selected from the group consisting of a zigzag alignment, a circular alignment, a rectangular alignment, and a two straight line alignment, which are radially spaced apart from each other.

12. A turbine comprising:

a rotor wheel comprising a plurality of dovetail grooves and a plurality of insertion grooves arranged along an axial direction of the turbine, the plurality of dovetail grooves and the plurality of insertion grooves arranged in a circumferential direction of the rotor wheel;

a plurality of first buckets, each of the plurality of the first buckets comprising a first vane, a first platform provided at a first end portion of the first vane, and a dovetail provided at the first platform and having a shape corresponding to a corresponding dovetail groove of the plurality of dovetail grooves;

at least one second bucket comprising a second vane, a second platform provided at a first end portion of the second vane, and a plurality of protrusions provided at the second platform and configured to be inserted into the plurality of insertion grooves; and a fixing member configured to be inserted through the plurality of protrusions and the rotor wheel and configured to restrict radial movement of the at least one second bucket, wherein the land portion extending circumferentially connects axial inner surfaces of each of the plurality of insertion grooves and a height of the land portion is lower than a height of a circumferential surface of the rotor wheel adjacent to the axial inner surfaces of each of the plurality of insertion grooves, the land portion configured to guide insertion and seating of the second platform.

13. A turbine comprising:

a rotor wheel comprising:

a plurality of dovetail grooves extending axially; and a plurality of insertion grooves arranged along an axial direction of the turbine and provided between the plurality of dovetail grooves;

a plurality of first buckets, each of the plurality of first buckets comprising a dovetail configured to engage with a corresponding dovetail groove of plurality of dovetail grooves, plurality of first buckets being axial entry type;

at least one second bucket comprising a protrusion portion inserted into the plurality of insertion grooves, the at least one second bucket being radial entry type; and a fixing member inserted through the plurality of insertion grooves and the protrusion portion and configured to restrict radial movement of the at least one second bucket, wherein the rotor wheel further comprising a land portion provided between the plurality of insertion grooves and the land portion and the plurality of insertion grooves are alternately arranged.

14. The turbine according to claim 13, wherein the protrusion portion comprises a plurality of protrusion portions provided at a platform of the second bucket, and each of the plurality of protrusion portions are axially spaced apart from one another.

15. The turbine according to claim 13, wherein each of opposite end portions of the fixing member comprises a deformation portion, and wherein the deformation portion protrudes from a side of the rotor wheel and configured to be mechanically deformed.

16. The turbine according to claim 15, wherein the deformation portion comprises a radially expanded portion.

17. A turbine comprising:

a rotor wheel comprising at least one insertion groove;

a plurality of first buckets inserted into the rotor wheel in an axial direction;

at least one second bucket inserted into the rotor wheel in a radial direction; and a plurality of fixing members configured to be inserted in the axial direction and to pass through a portion of the second bucket and the rotor wheel, opposite end portions of the fixing member protruding from a surface of the rotor wheel, wherein the plurality of fixing members are arranged in an alignment selected from the group consisting of a zigzag alignment, a circular alignment, rectangular alignment, and a two straight line alignment, which are radially spaced apart from each other in each of the at least one second bucket.

* * * * *